US010153618B2

(12) United States Patent
Mukoyama et al.

(10) Patent No.: US 10,153,618 B2
(45) Date of Patent: Dec. 11, 2018

(54) SPARK PLUG

(71) Applicant: NGK SPARK PLUG CO., LTD., Nagoya-shi, Aichi (JP)

(72) Inventors: Naoyuki Mukoyama, Nisshin (JP); Hiroyuki Kameda, Nagakute (JP)

(73) Assignee: NGK SPARK PLUG CO., LTD., Nagoya-shi (JP)

( * ) Notice: Subject to any disclaimer, the term of this patent is extended or adjusted under 35 U.S.C. 154(b) by 0 days.

(21) Appl. No.: 15/630,224

(22) Filed: Jun. 22, 2017

(65) Prior Publication Data

US 2018/0019578 A1 Jan. 18, 2018

(30) Foreign Application Priority Data

Jul. 18, 2016 (JP) ..... 2016-140963
Jan. 9, 2017 (JP) ..... 2017-001500

(51) Int. Cl.

| | |
|---|---|
| ***H01T 13/32*** | (2006.01) |
| ***H01T 13/08*** | (2006.01) |
| ***H01T 13/38*** | (2006.01) |
| ***H01T 13/39*** | (2006.01) |
| ***H01T 13/16*** | (2006.01) |
| ***H01T 13/20*** | (2006.01) |
| ***H01T 13/34*** | (2006.01) |
| ***H01T 13/36*** | (2006.01) |
| ***H01T 13/41*** | (2006.01) |

(52) U.S. Cl.

CPC ..... *H01T 13/32* (2013.01); *H01T 13/08* (2013.01); *H01T 13/16* (2013.01); *H01T 13/20* (2013.01); *H01T 13/34* (2013.01); *H01T 13/36* (2013.01); *H01T 13/38* (2013.01); *H01T 13/39* (2013.01); *H01T 13/41* (2013.01)

(58) Field of Classification Search

CPC ..... H01T 13/38; H01T 13/20; H01T 13/32
See application file for complete search history.

(56) References Cited

U.S. PATENT DOCUMENTS

2008/0054778 A1* 3/2008 Kumagai ..... H01T 13/36 313/143

FOREIGN PATENT DOCUMENTS

JP H06-176848 A 6/1994 ..... H01T 13/20
WO WO-2009/039478 A2 3/2009

OTHER PUBLICATIONS

Extended European Search Report issued in corresponding European Patent Application No. 17178901.9, dated Dec. 15, 2017.

* cited by examiner

*Primary Examiner* — Nimeshkumar Patel
*Assistant Examiner* — Jacob R Stern
(74) *Attorney, Agent, or Firm* — Kusner & Jaffe

(57) ABSTRACT

A spark plug having an insulator with a front end portion having an annular groove opened to a front side around an axial line. The groove has a width of greater than or equal to 0.2 mm in a radial direction. In a cross section including the axial line, a value D/L obtained by dividing, by a length L, a creepage distance D, from a position P on the frontmost side of a region in which a clearance distance between an outer surface of a front end portion and an inner circumferential surface of a metal shell is less than or equal to 0.1 mm to a connection position between an outer surface of the front end portion and the axial hole, is greater than or equal to 1.1.

11 Claims, 5 Drawing Sheets

SPARK PLUG

RELATED APPLICATION

This application claims the benefit of Japanese Patent Application No. 2016-140963, filed Jul. 18, 2016, and Japanese Patent Application No. 2017-001500, filed Jan. 9, 2017, the entire contents of which are incorporated herein by reference.

FIELD OF THE INVENTION

The present invention relates to a spark plug, and particularly a relates to a spark plug capable of ensuring insulation property.

BACKGROUND OF THE INVENTION

In a spark plug in which a center electrode is held in an insulated manner via an insulator by a metal shell, when carbon generated by incomplete combustion or the like is deposited on a surface of a front end portion of the insulator, decreasing insulation resistance, and an applied voltage is less than a required voltage (voltage that causes spark discharge), a spark discharge does not occur. In a spark plug having high heat resistance (higher heat rating), the insulator nose length (front end portion) is short, and a creepage distance, of the front end portion, from the metal shell to the center electrode is short. Therefore, there is a concern of a reduction in insulation property due to the deposit of carbon. On the other hand, in a spark plug having low heat resistance (lower heat rating), the insulator nose length is long, thus improving insulation property. However, there is a concern that heat transfer performance is not good and heat resistance is decreased.

For example, Japanese Patent Application Laid-Open (kokai) No. H6-176848 discloses a technique in which in a spark plug having low heat resistance (length of a front end portion is 17 mm), grooves opened to the radially outer side are provided at a relatively thick portion of the insulator nose length (front end portion). In this case, since carbon adhered to the front end portion can be made discontinuous in the axial direction by the grooves, it is possible to suppress a reduction in insulation property due to the deposit of carbon.

However, in the above conventional technique, there is a need for ensuring insulation property and improving heat resistance. In a spark plug having a higher heat rating, if grooves opened to a radially outer side are provided at a front end portion with reference to the technique of Japanese Patent Application Laid-Open (kokai) No. H6-176848 that is a technique of a spark plug having a lower heat rating, the strength of the insulator might be reduced. Therefore, it is impossible to ensure a sufficient creepage distance.

The present invention has been made in order to meet the aforementioned need. An advantage of the present invention is a spark plug that can realize both heat resistance and insulation property.

According to a first aspect of the present invention, there is provided a spark plug having a center electrode having a nose portion that extends from a front side to a rear side along an axial line, and a flange portion that projects to a radially outer side from a rear end of the nose portion. In an annular insulator, a receiving portion supporting the flange portion is formed on an axial hole formed along the axial line, and a step portion having a diameter that increases from the front side toward the rear side is formed on an outer circumferential surface. In a cylindrical metal shell disposed at the radially outer side of the insulator, a shelf portion supporting the step portion via a packing is formed on an inner circumferential surface. A front end portion of the insulator present on the front side with respect to a front end edge of a first contact surface that the packing contacts with, of the step portion, has a length L of less than or equal to 9 mm in an axial direction. Therefore, it is possible to shorten a heat dissipation path. Accordingly, it is possible to improve heat resistance of the spark plug.

In the front end portion, an annular groove opened to the front side is formed around the axial line. The groove has a width of greater than or equal to 0.2 mm in the radial direction. In a cross section including the axial line, a value D/L obtained by dividing, by the length L, a creepage distance D, from a position P on the frontmost side of a region in which a clearance distance between an outer surface of the front end portion and the inner circumferential surface of the metal shell is less than or equal to 0.1 mm to a connection position between the outer surface of the front end portion and the axial hole, is greater than or equal to 1.1. Since the annular groove is opened to the front side, it is possible to form a groove on a relatively thick portion separated by a predetermined distance from the front end of the insulator. Therefore, without reducing the strength of the insulator, it is possible to enlarge the ratio of the creepage distance of the front end portion to the length L. Since it is possible to suppress a decrease in insulation resistance of the front end portion to which carbon adheres, an effect of both realizing heat resistance and insulation property can be obtained.

According to a second aspect of the present invention, there is provided a spark plug as described above, wherein a position in the axial direction of a front end edge of a second contact surface that the flange portion contacts with, of the receiving portion, is the same as the position of the front end edge of the first contact surface or is located on the front side with respect to the front end edge of the first contact surface. Heat at a center side of the front end portion of the insulator can be mainly dissipated from the center electrode, and heat at an outer side of the front end portion can be mainly dissipated from the metal shell. Since it is possible to smoothly dissipate heat from a plurality of heat dissipation paths, not only an effect of claim 1 but also an effect of improving heat resistance can be obtained.

According to a third aspect of the present invention, there is provided a spark plug as described above, wherein a radially outside portion with respect to the groove, of the front end portion, has a front end surface at a position in the axial direction within 2 mm toward the front side from the position P. Since it is possible to shorten a heat dissipation path of a portion at the radially outer side portion with respect to the groove, of the front end portion, not only the effect of claim 1 or 2 but also an effect of improving heat resistance can be obtained.

According to a fourth aspect of the present invention, there is provided a spark plug as described above, wherein the insulator includes an annularly formed first member, and an annularly formed second member disposed at the radially outer side of the first member. The receiving portion is formed on the inner circumferential surface of the first member, and the step portion is formed on the outer circumferential surface of the second member. Since the groove is formed by a gap between the outer circumferential surface of the first member and the inner circumferential surface of the second member, it is possible to easily form the groove. As a result, not only the effect of one of claims 1 to 3 but also an effect of easily manufacturing a spark plug that can realize both heat resistance and insulation property can be obtained.

DETAILED DESCRIPTION OF THE PREFERRED EMBODIMENTS

Figure 1:
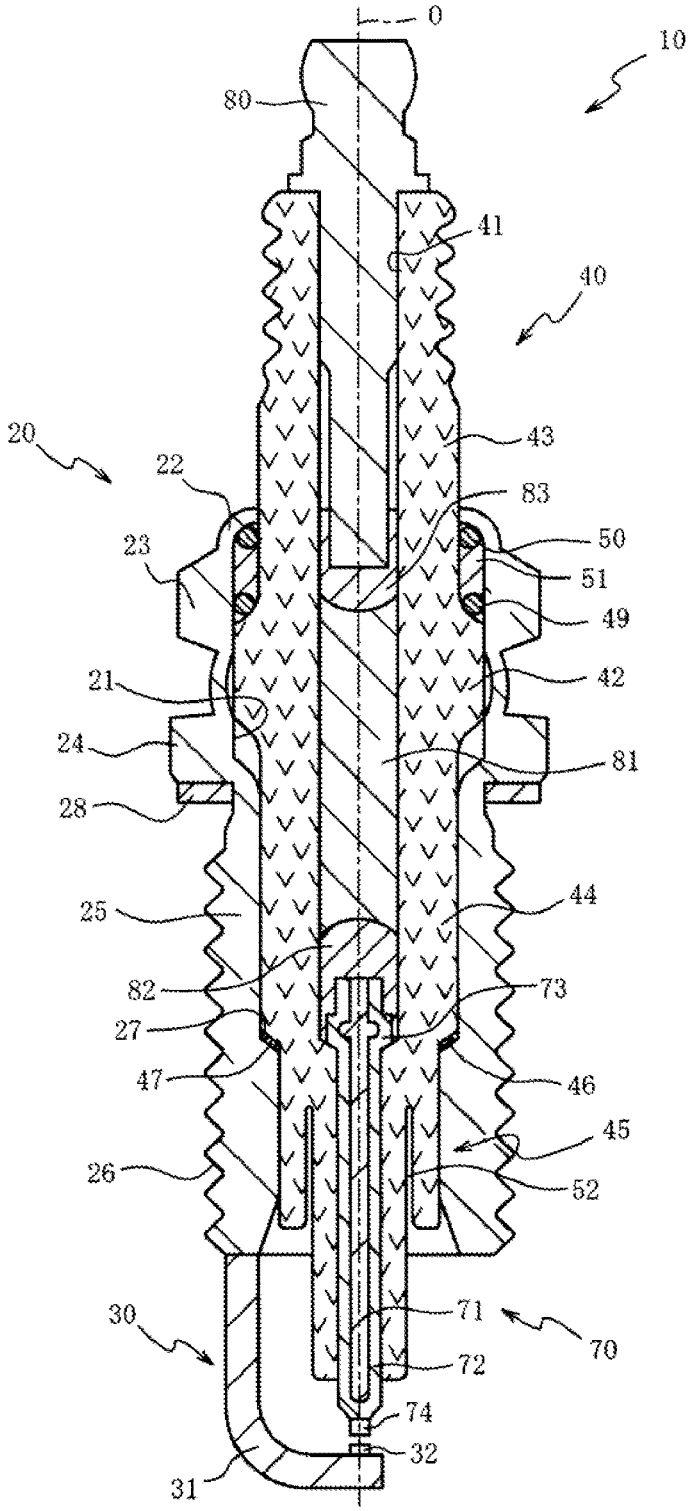
FIG. 1 is a cross-sectional view of a spark plug according to a first embodiment of the present invention.
Figure 2:
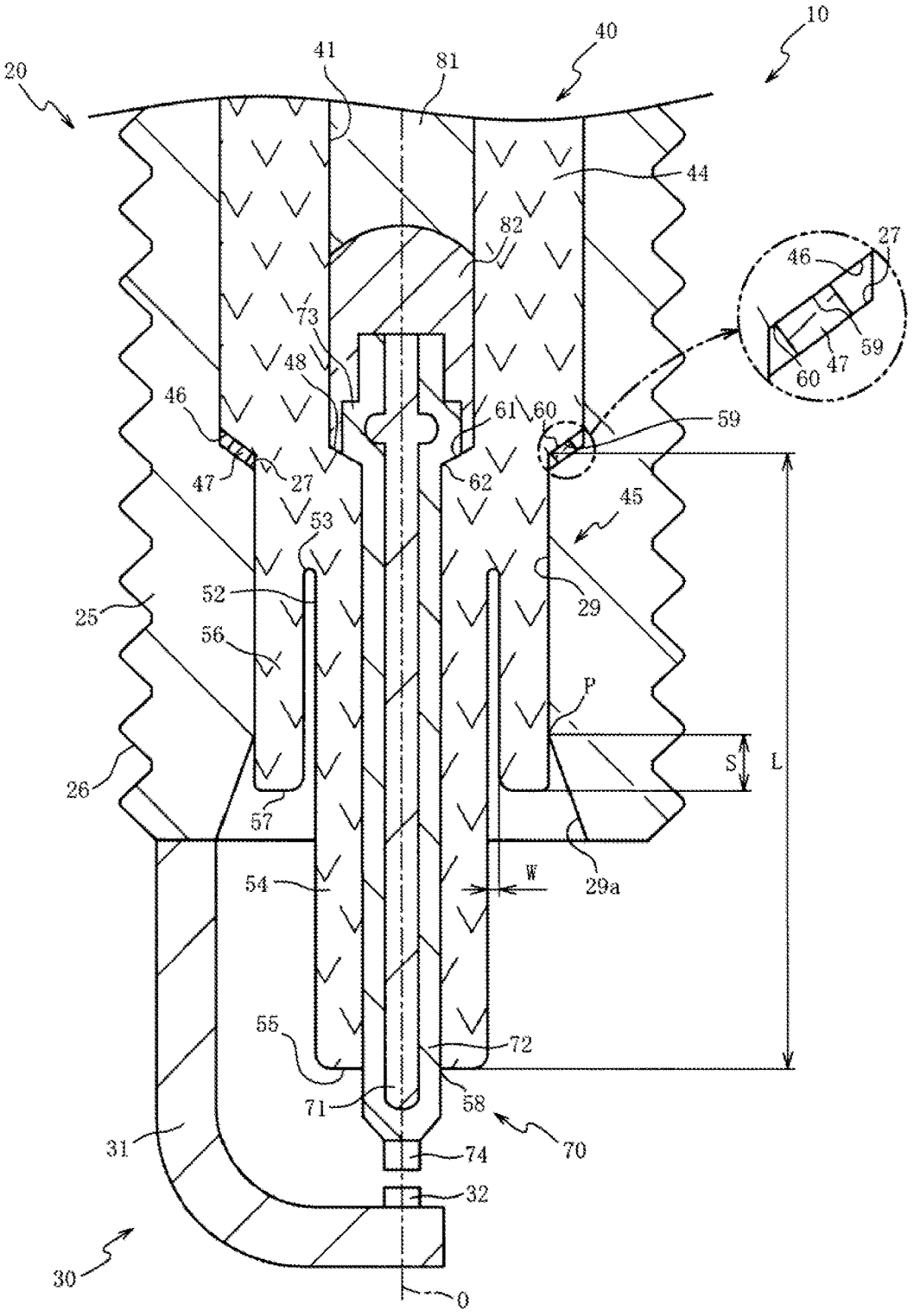
FIG. 2 is a cross-sectional view of a front end portion of the spark plug.

Hereinafter, preferred embodiments of the present invention will be described with reference to the accompanying drawings. FIG. 1 is a cross-sectional view of a spark plug 10, according to a first embodiment of the present invention, taken along a plane including an axial line O. FIG. 2 is a sectional view of a front end portion 45 in the plane including the axial line O of the spark plug 10. In FIGS. 1 and 2, the lower side on the drawing sheet is referred to as a front side of the spark plug 10, and the upper side on the drawing sheet is referred to as a rear side of the spark plug 10. As shown in FIG. 1, the spark plug 10 includes a metal shell 20, an insulator 40, and a center electrode 70.

The metal shell 20 is an almost cylindrical member that is fixed to a screw hole (not shown) of an internal combustion engine, and has a through hole 21 that penetrates the center along the axial line O. The metal shell 20 is formed of a metal material (for example, low-carbon steel or the like) having conductivity. Along the axial line O from the rear side to the front side, a crimping portion 22, a tool engagement portion 23, a seat portion 24, and a trunk portion 25 are disposed. In the trunk portion 25, a thread portion 26 that is fitted into a screw hole of the internal combustion engine is formed on an outer circumferential surface.

The crimping portion 22 is a portion for crimping the insulator 40. The tool engagement portion 23 is a portion to be engaged with a tool such as a wrench when the thread portion 26 is fitted into the screw hole (not shown) of the internal combustion engine. The seat portion 24 is a portion for pressing a gasket 28 fitted between the seat portion 24 and the trunk portion 25. The gasket 28 is interposed between the seat portion 24 and the internal combustion engine, and seals a gap between the thread portion 26 and the screw hole. In the trunk portion 25, a shelf portion 27 projecting to the radially inner side is formed on the inner circumferential surface. The shelf portion 27 has a diameter that decreases from the rear side toward the front side.

The ground electrode 30 includes: an electrode base material 31 which is made of a metal (for example, a nickel-based alloy) and is joined to the front end of the metal shell 20 (the end surface of the trunk portion 25); and a tip 32 joined to the end of the electrode base material 31. The electrode base material 31 is a rod-shaped member that is bent toward the axial line O so as to intersect the axial line O. The tip 32 is a member formed of a noble metal such as platinum, iridium, ruthenium, or rhodium, or an alloy containing such a noble metal as a main component. The tip 32 is joined at such a position that intersects the axial line O.

The insulator 40 is an almost cylindrical member formed of alumina or the like which is excellent in mechanical property and insulation property at a high temperature. The insulator 40 has an axial hole 41 that penetrates therethrough along the axial line O. A projection portion 42 is formed at a center in the axial line O direction and has the largest outer shape. In the insulator 40, a rear trunk portion 43 is formed on the rear side with respect to the projection portion 42, and a middle trunk portion 44 and a front end portion 45 are formed on the front side with respect to the projection portion 42.

The front end portion 45 is a tubular portion which has an outer diameter smaller than the outer diameter of the middle trunk portion 44. A step portion 46 having a diameter that decreases toward the front side is formed between the middle trunk portion 44 and the front end portion 45. A packing 47 is disposed between the step portion 46 and the shelf portion 27 of the metal shell 20. The packing 47 is an annular plate material formed from a soft metal material, such as a mild steel plate, that is softer than the metal material forming the metal shell 20.

The insulator 40 has a receiving portion 48 located on the inner circumferential surface of the middle trunk portion 44 and projecting to the radially inner side. The receiving portion 48 has a diameter that decreases from the rear side toward the front side. The insulator 40 is inserted into the through hole 21 of the metal shell 20, and the metal shell 20 is fixed on the outer circumference of the insulator 40. The front end of the front end portion 45 and the rear end of the rear trunk portion 43 of the insulator 40 are exposed from the through hole 21 of the metal shell 20. The insulator 40 has a groove 52 at the front end portion 45.

Ring members 49 and 50 are interposed between: the crimping portion 22 and the tool engagement portion 23 of the metal shell 20; and the rear trunk portion 43 of the insulator 40, A filler 51 such as talc is filled between the ring members 49 and 50. When the crimping portion 22 is crimped, the insulator 40 is pressed in the axial line O direction via the ring members 49 and 50 and the filler 51. As a result, the packing 47 disposed between the shelf portion 27 of the metal shell 20 and the step portion 46 of the insulator 40 is deformed, and closely contacts the shelf portion 27 and the step portion 46.

The center electrode 70 is a rod-shaped electrode in which, in a tubular electrode base material having the bottom, a core material 71 having a thermal conductivity that is more excellent than the electrode base material is embedded. The core material 71 is formed of copper or an alloy containing copper as a main component. The center electrode 70 includes a nose portion 72 that extends toward the front side in the axial hole 41 along the axial line O, and a flange portion 73 provided on the rear side of the nose portion 72. The flange portion 73 is fitted to the receiving portion 48 formed in the insulator 40 (the middle trunk portion 44). The nose portion 72 has a front end that projects from the axial hole 41, and a tip 74 is joined to the front end. The tip 74 is a columnar member formed of a noble metal such as platinum, iridium, ruthenium, or rhodium, or an alloy containing such a noble metal as a main component.

A metal terminal 80 is a rod-shaped member to which a high-voltage cable (not shown is connected, and is formed of a metal material (for example, low-carbon steel or the like) having conductivity. The front side portion of the metal terminal 80 is disposed in the axial hole 41 of the insulator 40. A resistor 81 is a member for reducing electric wave noise generated when spark occurs, and is disposed in the axial hole 41 between the metal terminal 80 and the center electrode 70. The resistor 81 is electrically connected to the center electrode 70 and the metal terminal 80, via conductive seals 82 and 83 made from glass and mixed with metal powder.

With reference to FIG. 2, the front end portion 45 of the insulator 40 will be described. The front end portion 45 is a portion located on the front side with respect to a front end edge 60 of a first contact surface 59 that the packing 47 contacts with, of the step portion 46 of the insulator 40 (lower side of FIG. 2). The front end edge 60 is an edge present on the frontmost side of the first contact surface 59, that is, present near the axial line O. A front end edge 62 of a second contact surface 61 that the flange portion 73 contacts with, of the receiving portion 48 of the insulator 40, is at the same position in the axial direction as the position of the front end edge 60 in the axial direction, or is located on the front side (lower side of FIG. 2) with respect to the position of the front end edge 60 in the axial direction. The front end edge 62 is an edge that is present on the frontmost side of the second contact surface 61, that is, near the axial line O.

The front end portion 45 has a gap (clearance distance) between an outer surface and an inner circumferential surface 29 of the trunk portion 25 of the metal shell 20, which is set to less than or equal to 0.1 mm. This is because heat is easily dissipated from the front end portion 45 to the trunk portion 25. Similarly, the front end portion 45 has a gap (clearance distance) between the nose portion 72 of the center electrode 70 and the axial hole 41, which is set to less than or equal to 0.1 mm. This is because heat is easily dissipated from the front end portion 45 to the center electrode 70. The front end portion 45 has a length L, in the axial direction, from the front end edge 60 to a front end surface 55, which is set to less than or equal to 9 mm. This is because heat resistance is improved by shortening a heat dissipation path of the front end portion 45.

The metal shell 20 has an inclined surface 29*a* located on the front side of the inner circumferential surface 29 of the trunk portion 25 and having a diameter that increases toward the front side. The inclined surface 29*a* has a clearance distance between the front end portion 45 and the inclined surface 29*a* (metal shell 20), which increases toward the front side. A position P is a position on the frontmost side of the region in which a clearance distance between the outer surface of the front end portion 45 and the inner circumferential surface 29 of the trunk portion 25 is less than or equal to 0.1 mm.

The front end portion 45 has an annular groove 52 opened to the front side (lower side of FIG. 2) and is formed around the axial line O. The groove 52 has a width W of greater than or equal to 0.2 mm in the radial direction. The groove 52 having the width W of greater than or equal to 0.2 mm can suppress crosslinking of carbon, in the width direction of the groove 52, generated by incomplete combustion, or the like. Since the groove 52 is formed at the front end portion 45, a surface area of the outer surface of the front end portion 45 can be enlarged as compared to the case without the groove 52. The groove 52 is formed by molding or processing before sintering of the insulator 40, or cut-processing after sintering of the insulator 40.

In the front end portion 45, a value D/L obtained by dividing, by the length L, the creepage distance L) from a connection position 58 between the axial hole 41 and the outer surface of the front end portion 45 to the position P is greater than or equal to 1.1. D/L is an index representing the ratio of the surface area of the front end portion 45 to the length L. By satisfying D/L≥1.1, the creepage distance of the groove 52 makes it possible to enlarge the ratio of the creepage distance D of the outer surface of the front end portion 45 to the length L of the front end portion 45. Since the surface area of the front end portion 15 can be enlarged, it is possible to suppress a decrease in insulation resistance of the front end portion 45, when carbon adheres to the surface thereof. As a result, it is possible to realize both heat resistance and insulation property of the spark plug 10.

One or a plurality of the grooves 52 are formed at the front end portion 45. In the present embodiment, the case is illustrated where the number of the grooves 52 is one. When the number of the grooves is one, the groove 52 is preferably provided between the outer circumference of the front end portion 45 and a position corresponding to half the thickness in the radial direction of the front end portion 45. This is because a radially inside portion with respect to the groove 52 causes heat to be mainly dissipated from the center electrode 70 having thermal resistance lower than the metal shell 20, and a radially outside portion with respect to the groove 52 causes heat to be mainly dissipated from the metal shell 20.

When there is a plurality of grooves, the grooves are disposed in a concentric manner around the axial line O, as seen from the axial direction. When there are a plurality of grooves, a depth of each of the grooves (length in the axial direction) can be arbitrarily set.

The position in the axial direction of the front end edge 62 of the second contact surface 61 is the same as the position of the front end edge 60 of the first contact surface 59, or is located on the front side (lower side of FIG. 2) with respect to the front end edge 60 of the first contact surface 59. Therefore, heat at a center side of the front end portion 45 can be mainly dissipated from the center electrode 70, and heat at an outer side of the front end portion 45 can be mainly dissipated from the metal shell 20. Since heat can be smoothly dissipated from a plurality of heat dissipation paths, heat dissipation performance can be improved. As a result, it is possible to improve the heat resistance of the spark plug 10.

The front end portion 45 is divided, by the groove 52, into a first portion 54 at a radially inner side with respect to the groove 52 and a second portion 56 at a radially outer side with respect to the groove 52. An upper limit of the width W of the groove 52 is set such that the thickness of each of the first portion 54 and the second portion 56 (the rest other than the groove 52 of the front end portion 45) is greater than or equal to 0.7 mm in the radial direction. This is because the mechanical strength of the first portion 54 and the second portion 56 is to be ensured.

In the spark plug 10 having a higher heat rating, since the length L of the front end portion 45 in the axial direction is short, the length of a relatively thick portion separated from the front end of the front end portion 45 in the axial direction by a predetermined distance is also short. Therefore, as in Japanese Patent Application Laid-Open (kokai) No. H6-176848, even if the grooves opened to the radially outer side are provided at a relatively thick portion of the front end portion 45, a large number of grooves cannot be provided. Therefore, the creepage distance D cannot be increased greatly. When the grooves opened to the radially outer side are provided also at a relatively thin portion of the front end portion 45 in order to secure the creepage distance D, the strength of the insulator 40 might be reduced.

On the other hand, in the spark plug 10, the groove 52 opened to the front side is provided at the front end portion 45. Therefore, unlike Japanese Patent Application Laid-Open (kokai) No. H6-176848 in which the insulator is provided with the groove opened to the radially outer side, it is possible to enlarge the ratio of the creepage distance of the front end portion 45 to the length L of the front end portion 45 without reducing the strength of the insulator 40. Accordingly, the spark plug 10 is able to realize both heat resistance and insulation property while ensuring the strength of the insulator 40.

The front end surface 55 of the first portion 54 is located at the axial front side (lower side of FIG. 2) with respect to a front end surface 57 of the second portion 56, and the front end surface 57 is present within a range of 2 mm in the axial direction from the position P. Since the groove 52 is present between the second portion 56 and the first portion 54, it is effective that heat of the second portion 56 is mainly dissipated to the metal shell 20. When a distance S in the axial direction between the front end surface 57 of the second portion 56 and the position P is set to less than or equal to 2 mm, it is possible to shorten the heat dissipation path from the second portion 56 to the trunk portion 25 and therefore it is possible to improve heat resistance.

In the groove 52, a bottom portion 53 in the axial direction is located on the front side (lower side of FIG. 2) of the front end portion 45 with respect to the front end edge 60. When the bottom portion 53 of the groove 52 is located on the rear side (upper side of FIG. 2) with respect to the front end edge 60, a vicinity of the bottom portion 53 of the groove 52 is a barrier. Therefore, it is difficult to dissipate heat of the first portion 54 from the packing 47 to the metal shell 20. Similarly, it is difficult to dissipate heat of the second portion 56 to the center electrode 70. As a result, heat dissipation performance might be deteriorated.

On the other hand, when the bottom portion 53 of the groove 52 is disposed on the front side (lower side of FIG. 2) with respect to the front end edge 60, it is easy to dissipate heat of the first portion 54 and the second portion 56 to the metal shell 20 and the center electrode 70. Since heat dissipation performance of the front end portion 45 is ensured, it is possible to ensure heat resistance of the spark plug 10.

Next, a second embodiment will be described with reference to FIG. 3. In the first embodiment, the case has been described where the groove 52 is formed in an axial end surface of the insulator 40. In the second embodiment, the case will be described where an insulator 100 includes a first member 110 and a second member 120, and the groove is formed by a gap 125 between an outer circumferential surface 114 of the first member 110 and an inner circumferential surface 123 of the second member 120. The same components as described for the first embodiment will be denoted by the same reference numerals, and the description thereof is omitted.

Figure 3:
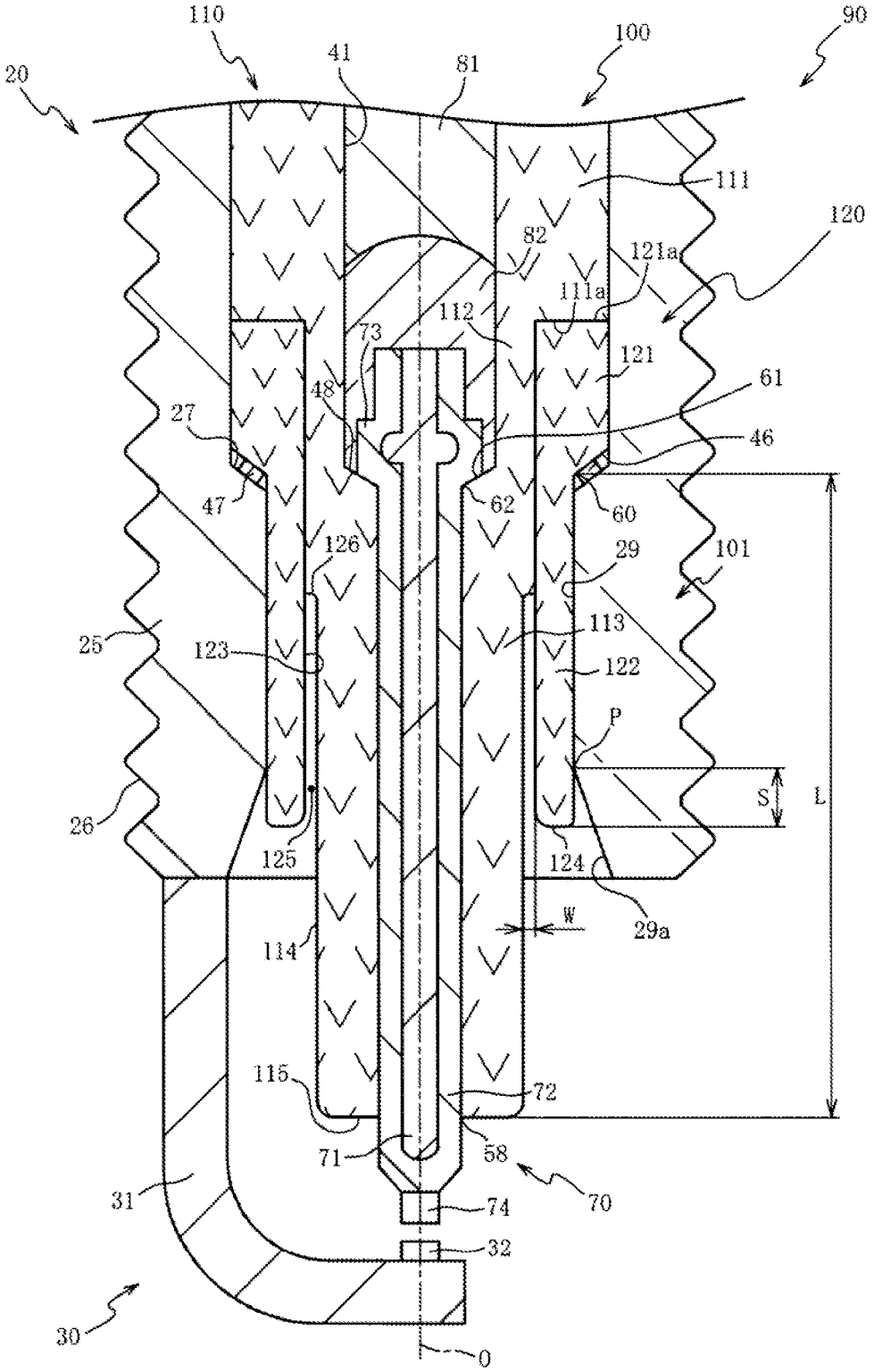
FIG. 3 is a cross-sectional view of a spark plug according to a second embodiment of the present invention.

FIG. 3 is a sectional view of a front end portion 101 in a plane including the axial line O of a spark plug 90. In the spark plug 90, the insulator 100 is formed with the first member 110 and the second member 120. The second member 120 is a member disposed at the radially outer side of the first member 110. Parts of the first member 110 and the second member 120 form the front end portion 101. The first member 110 and the second member 120 are formed of alumina, aluminum nitride, etc. A material may be the same or different between the first member 110 and the second member 120.

In the first member 110, a trunk portion 111, a connection portion 112, and a first portion 113 are connected to each other on the axial front side of the projection portion 42 (refer to FIG. 1) along the axial line O. The connection portion 112 is a cylindrical portion that connects the radially inner side of the trunk portion 111 and the first portion 113 in which the receiving portion 48 is formed on the inner circumference thereof. An outer diameter of the connection portion 112 is formed to be smaller than the outer diameter of the trunk portion 111. The first portion 113 is a cylindrical portion disposed at the radially outer side of the nose portion 72 of the center electrode 70. The clearance distance of a gap between the nose portion 72 and the first portion 113 is set to less than or equal to 0.1 mm.

The second member 120 is a cylindrical member disposed on the front side of the trunk portion 111 and the radially outer side of the connection portion 112 and the first portion 113. An annular portion 121 and a second portion 122 are connected to each other in the axial direction. The annular portion 121 is an annular portion disposed at the radially outer side of the connection portion 112. In the annular portion 121, a rear end surface 121*a* contacts with a front end surface 111*a* of the trunk portion 111, and the step portion 46 is formed at the front end thereof. The second portion 122 is a cylindrical portion having an outer diameter smaller than the outer diameter of the annular portion 121, and is disposed at the radially inner side of the trunk portion 25 of the metal shell 20. The clearance distance of a gap between the second portion 122 and the inner circumferential surface 29 (except the inclined surface 29*a*) of the trunk portion 25 is set to less than or equal to 0.1 mm.

The clearance distance of a gap 125 between the inner circumferential surface 123 of the second portion 122 and the outer circumferential surface 114 of the first portion 113 is set to greater than or equal to 0.2 mm, thus forming a groove. A bottom portion 126 of the gap 125 (groove) is disposed on the front side (lower side of FIG. 3) with respect to the front end edge 60. As a result, it becomes easy to dissipate heat of the first portion 113 and the second portion 122 to the metal shell 2 and the center electrode 70, and it is possible to ensure heat dissipation performance of the front end portion 101.

It is commonly possible that a heat transfer layer, made from an inorganic adhesive (so-called cement) or a material similar to the conductive seal 82 (for example, a composition that includes glass particles of a B2O3—SiO2-based material or the like, and metal particles such as Cu or Fe), or the like, is interposed between the first member 110 and the second member 120 (except the gap 125). The heat transfer layer makes it possible to improve thermal conductivity between the first member 110 and the second member 120. But the heat transfer layer may not be provided.

An interval (clearance distance) of a portion (except the gap 125) in which the first member 110 and the second member 120 oppose each other is less than or equal to 0.1 mm. When the heat transfer layer is interposed between the first member 110 and the second member 120, the interval (clearance distance) between the heat transfer layer and one of the first member 110 and the second member 120 is set to less than or equal to 0.1 mm. Accordingly, it is easy to transfer heat between the first member 110 and the second member 120, except the gap 125.

In the front end portion 101, the length L from the front end edge 60 to a front end surface 115 in the axial direction is set to less than or equal to 9 mm. The position P is a position on the frontmost side of the region in which the clearance distance between the outer surface of the second portion 122 and the inner circumferential surface 29 of the trunk portion 25 is less than or equal to 0.1 mm. The value D/L obtained by dividing, by the length L, the creepage distance L) from the connection position 58 between the axial hole 41 of the first member 110 and the front end surface 115 of the first portion 113 to the position P is set to greater than or equal to 1.1. Accordingly, as in the first embodiment, it is possible to realize both heat resistance and insulation property of the spark plug 90.

In the first member 110 in which the first portion 113 is disposed around the center electrode 70, heat is mainly dissipated from the center electrode 70. In the second member 120 in which the second portion 122 is disposed inside the trunk portion 25, heat is mainly dissipated from the trunk portion 25. A front end surface 124 of the second portion 122 is located on an axially rear side (upper side of FIG. 3) with respect to the front end surface 115 of the first portion 113. The front end surface 124 is present within a range of 2 mm in the axial direction from the position P. Accordingly, it is possible to improve heat resistance of the second member 120.

The groove is formed by disposing the second member 120 at the radially outer side of the first member 110 and using the gap 125 between the first member 110 and the second member 120. Therefore, it is easy to form an elongated groove that is difficult to be formed in a single member. According to the present embodiment, in addition to the effect obtained in the first embodiment, it is possible to easily manufacture the spark plug 90 that can realize both heat resistance and insulation property. Furthermore, the spark plug 90 makes it possible to improve a degree of freedom in design of the gap 125 (groove).

Next, a third embodiment will be described with reference to FIG. 4. In the second embodiment, the case has been described where the projection portion 42 (refer to FIG. 1) is formed integrally with the first member 110. In the third embodiment, the case will be described where the projection portion 42 is formed integrally with a second member 160. The same components as described for the first embodiment will be denoted by the same reference numerals, and the description thereof is omitted.

Figure 4:
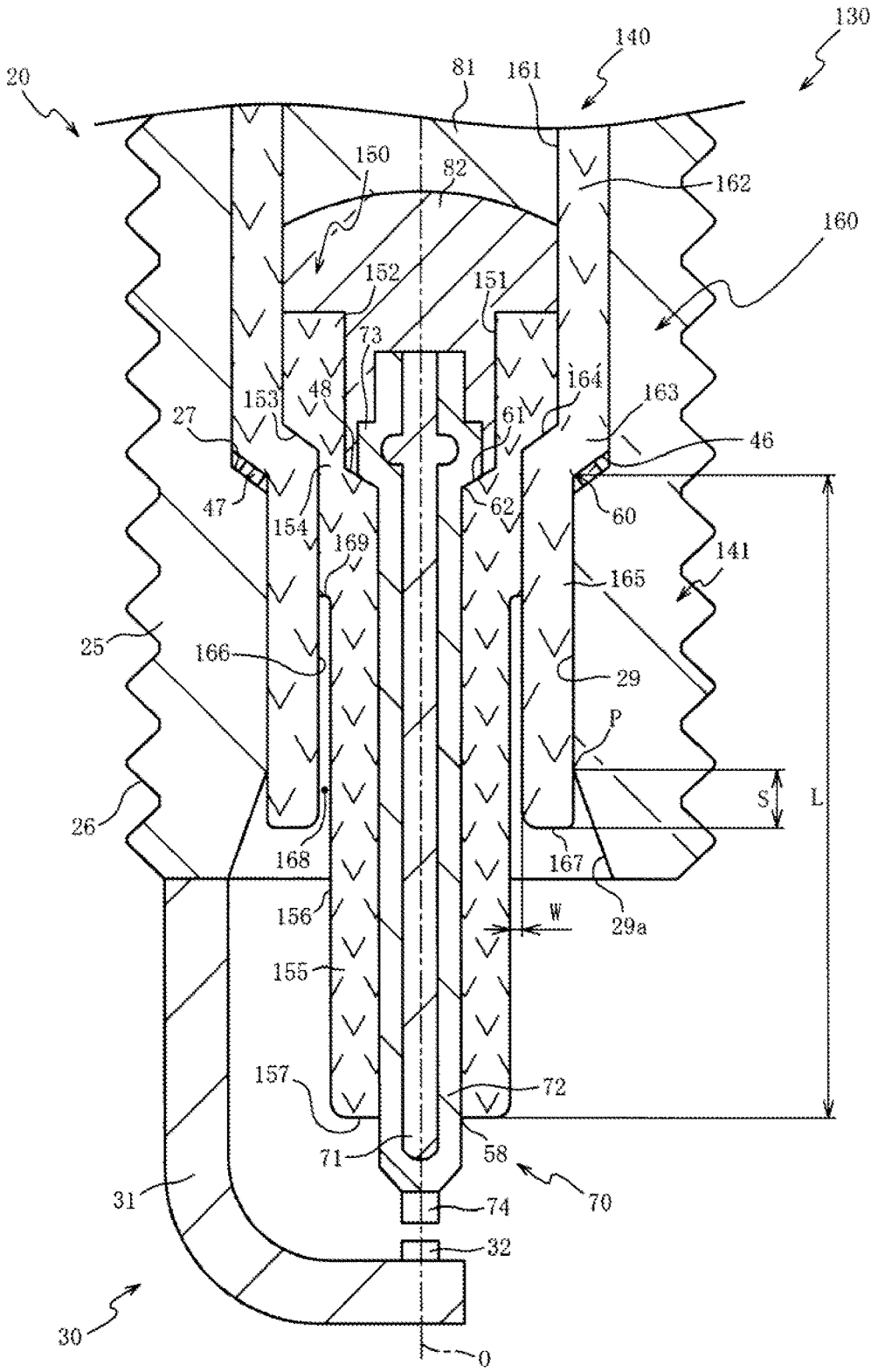
FIG. 4 is a cross-sectional view of a spark plug according to a third embodiment of the present invention.

FIG. 4 is a sectional view of a front end portion 141 in a plane including the axial line O of a spark plug 130. In the spark plug 130, an insulator 140 is formed with a first member 150 and the second member 160. The second member 160 is a member disposed at the radially outer side of the first member 150. The first member 150 and the second member 160 each are formed by alumina, aluminum nitride, etc. A material may be the same or different between the first member 150 and the second member 160.

Parts of the first member 150 and the second member 160 form the front end portion 141. The first member 150 is a cylindrical member in which an axial hole 151 penetrating the center is formed. An annular portion 152, a connection portion 154, and a first portion 155 are connected to each other in the axial direction.

The second member 160 is a cylindrical member in which an axial hole 161 penetrating the center is formed. A trunk portion 162, a connection portion 163, and a second portion 165 are connected to each other on the axial front side of the projection portion 42 (refer to FIG. 1) along the axial line O. The trunk portion 162 is a portion disposed at the radially outer side of the annular portion 152.

The connection portion 163 is an annular portion that connects the trunk portion 162 and the second portion 165, and the step portion 46 is formed on the front end of the outer circumference. In the connection portion 163, an engagement portion 164 projecting toward the radially inner side is formed on the inner circumference thereof. The engagement portion 164 has a diameter that decreases from the rear side toward the front side (lower side of FIG. 4). The second portion 165 is a cylindrical portion having an outer diameter smaller than the outer diameter of the connection portion 163, and is disposed at the radially inner side of the trunk portion 25 of the metal shell 20. The clearance distance of a gap between the inner circumferential surface 29 (except the inclined surface 29*a*) of the trunk portion 25 and the second portion 165 is set to less than or equal to 0.1 mm.

The first member 150 is a member inserted into the axial hole 161 of the second member 160, and the center electrode 70 is inserted into the axial hole 15 of the first member 150. In the annular portion 152, an engagement portion 153 is formed on the front end of the outer circumference. The engagement portion 153 is a portion which engages with the engagement portion 164 of the second member 160 in the axial direction. The engagement portion 153 has a diameter that decreases from the rear side toward the front side. The connection portion 154 is a cylindrical portion that connects the radially inner side of the annular portion 152 and the first portion 155 in which the receiving portion 48 is formed on the inner circumference thereof. An outer diameter of the connection portion 154 is formed to be smaller than the outer diameter of the annular portion 152. The first portion 155 is a cylindrical portion disposed at the radially outer side of the nose portion 72 of the center electrode 70. The clearance distance of a gap between the nose portion 72 and the axial hole 151 is set to less than or equal to 0.1 mm.

The groove is formed by a gap 168 between an outer circumferential surface 156 of the first portion 155 and an inner circumferential surface 166 of the second portion 165. The clearance distance of the gap 168 is set to greater than or equal to 0.2 mm. The interval (clearance distance) of a portion in which the first member 150 and the second member 160 oppose each other (except the gap 168) is less than or equal to 0.1 mm. A bottom portion 169 of the gap 168 (groove) is disposed on the front side (lower side of FIG. 4) with respect to the front end edge 60. As a result, it is possible to easily dissipate heat of the first portion 155 and the second portion 165 to the metal shell 20 and the center electrode 70. Therefore, it is possible to ensure heat dissipation performance of the front end portion 141.

When a heat transfer layer such as an inorganic adhesive is interposed between the first member 150 and the second member 160, the interval (clearance distance) between the heat transfer layer and one of the first member 150 and the second member 160 is set to less than or equal to 0.1 mm. Accordingly, it is possible to easily transfer heat between the first member 150 and the second member 160 except the gap 168.

In the front end portion 141, the length L from the front end edge 60 to a front end surface 157 of the first portion 155 in the axial direction is set to less than or equal to 9 mm. The position P is a position on the frontmost side of the region in which the clearance distance between the outer surface of the second portion 165 and the inner circumferential surface 29 of the trunk portion 25 is less than or equal to 0.1 mm. The value D/L obtained by dividing, by the length L, the creepage distance D from the connection position 58 between the axial hole 151 of the first member 150 and the front end surface 157 of the first portion 155 to the position P is set to greater than or equal to 1.1. Accordingly, as in the first embodiment, it is possible to realize both heat resistance and insulation property of the spark plug 130.

A front end surface 167 of the second portion 165 is located on the axially rear side (upper side of FIG. 4) with respect to the front end surface 157 of the first portion 155. The front end surface 167 is present within a range of 2 mm in the axial direction from the position P. Accordingly, it is possible to improve heat resistance of the second member 160. The groove is formed by disposing the second member 160 at the radially outer side of the first member 150 and using the gap 168 between the first member 150 and the second member 160. Therefore it is possible to obtain the same effect as in the second embodiment.

EXAMPLES

The present invention will be more specifically described according to examples. However, the present invention is not limited to the examples.

Example 1

An examiner prepared various samples different in the length of a groove in the axial direction and the width of a groove in the radial direction, while fixing, at 4 mm, the creepage distance from a groove 123 to the connection position 58 between the axial hole 41 and the outer surface of the front end portion 101 (refer to FIG. 3) of the insulator (excluding the creepage distance inside the groove 123). Except the difference in a dimension of each portion, the samples are the same as the spark plug 90 in the second embodiment (the insulator is divided into the first member and the second member).

The examiner mounted each of the samples on a four-cylinder DOHC engine having a displacement of 1.6 L, measured insulation resistance between a metal shell and a metal terminal of each sample while an engine was in operation, and measured the time until the insulation resistance decreases to 1000 MΩ, after the start of the engine. According to an engine operating condition, the rotation rate was 2000 rpm and the air-fuel ratio was 10.

Figure 5:
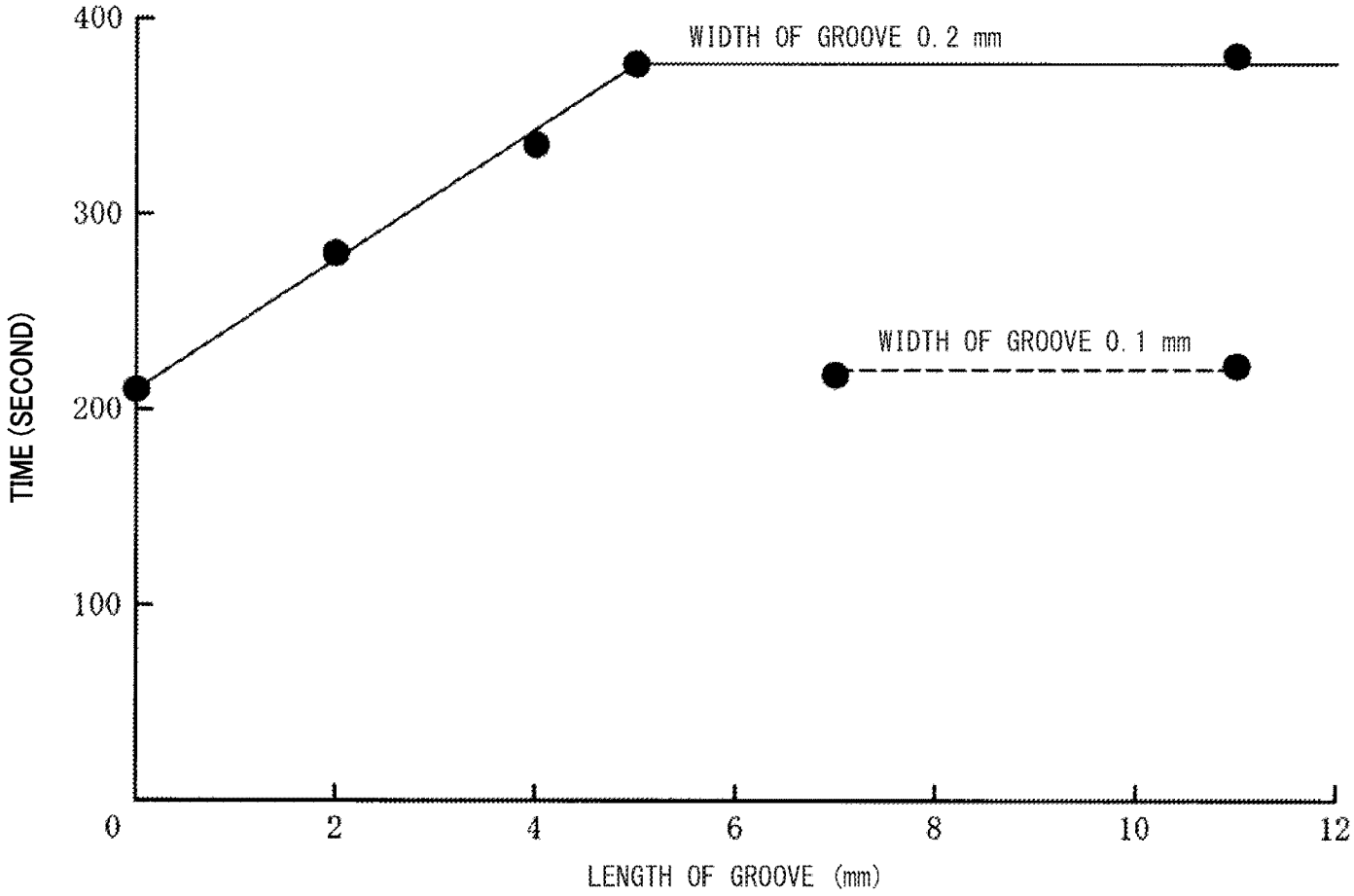
FIG. 5 is a diagram indicating a relationship between a length of a groove and time until insulation resistance decreases to 1000 MΩ.

FIG. 5 is a diagram indicating a relationship between the length of a groove and the time until the insulation resistance decreases to 1000 MΩ. The solid line represents a result of a sample in which the width of the groove in the radial direction was 0.2 mm. The broken line represents a result of a sample in which the width of the groove in the radial direction was 0.1 mm.

As shown in FIG. 5, the time was about 200 seconds until the insulation resistance decreased in the sample in which the width of the groove is 0.1 mm. This was almost the same as the result of a sample in which the length of the groove with the width of 0.2 mm was 0 mm (sample without groove). In the sample in which the width of the groove in the radial direction was 0.2 mm, as the length of the groove increases, the time until the insulation resistance decreases is gradually prolonged, to reach saturation when the length of the groove was greater than or equal to 5 mm. According to this example, in order to improve the insulation property, it was found that the groove needs to have a width of greater than or equal to 0.2 mm in the radial direction and that 5 mm is sufficient for the length in the axial direction of the groove.

Example 2

The examiner prepared samples 1 to 4 each of which having the groove at the front end portion of the insulator, and samples 5 to 10 without the groove. In the samples 1 to 4 having the grooves, the width of the groove in the radial direction was 0.2 mm, and there are differences in the creepage distance D and the length L of the front end portion. Except a dimension of each portion, the samples 1 to 3 are the same as the spark plug 10 in the first embodiment. Except a dimension of each portion, the sample 4 is the same as the spark plug 90 in the second embodiment (the insulator is divided into the first member and the second member). The samples 5 to 10 are the same as the spark plug 10 in the first embodiment, except absence of the groove and difference in a dimension of each portion.

(Evaluation Method for Heat Resistance)

The examiner mounted each of the samples on a four-cylinder DOHC engine having a displacement of 1.6 L, operated an engine, and detected the presence/absence of pre-ignition. According to an engine operating condition, while a throttle valve was fully open, the rotation rate was 6000 rpm, the air-fuel ratio was 12, and ignition timing was set to BTDC 40°. A series of steps of the engine was regarded as one cycle, and the engine was operated until the cycle was repeated 1000 times.

The sample in which no pre-ignition was detected during the operation of 1000 cycles was evaluated as "excellent". The sample in which one pre-ignition was detected during the operation of 1000 cycles was evaluated as "good". The sample in which two or more pre-ignitions were detected during the operation of 1000 cycles was evaluated as "poor".

(Evaluation Method for Insulation Property)

The examiner mounted each of the samples on a four-cylinder DOHC engine having a displacement of 1.6 L, measured insulation resistance between a metal shell and a metal terminal of each sample while an engine was in operation, and measured the time until the insulation resistance decreases to 1000 MΩ, after the start of the engine. According to an engine operating condition, while a throttle valve was fully open, the rotation rate was 6000 rpm and the air-fuel ratio was 10.

The sample in which the time until the insulation resistance decreases to 1000 MΩ, after the start of the engine, was greater than or equal to 250 seconds was evaluated as "excellent". The sample in which the time was greater than or equal to 200 seconds and less than 250 seconds was evaluated as "good". The sample in which the time was greater than or equal to 100 seconds and less than 200 seconds was evaluated as "normal". Results are indicated in Table 1.

TABLE 1

| No | Number of insulators | Number of grooves | L (mm) | D (mm) | D/L | Heat resistance | Insulation property |
|---|---|---|---|---|---|---|---|
| 1 | 1 | 1 | 11 | 12.0 | 1.09 | Normal | Good |
| 2 | 1 | 1 | 10 | 12.0 | 1.20 | Good | Good |
| 3 | 1 | 1 | 9 | 12.0 | 1.33 | Good | Good |
| 4 | 2 | 1 | 9 | 14.0 | 1.56 | Good | Excellent |
| 5 | 1 | 0 | 12 | 12.3 | 1.03 | Normal | Good |
| 6 | 1 | 0 | 11 | 11.5 | 1.05 | Normal | Good |
| 7 | 1 | 0 | 10 | 10.4 | 1.04 | Normal | Normal |
| 8 | 1 | 0 | 9 | 9.3 | 1.03 | Good | Normal |
| 9 | 1 | 0 | 8 | 8.3 | 1.04 | Good | Normal |
| 10 | 1 | 0 | 7 | 7.3 | 1.04 | Good | Normal |

As indicated in Table 1, none of the samples 5 to 10 without the groove were not evaluated as "good" both in heat resistance and insulation property. Especially, the samples 8 to 10 in which the length L of the front end portion was less than or equal to 9 mm were evaluated as "normal" in insulation property.

On the other hand, the samples 1 to 4 having the grooves were evaluated as "good" in heat resistance, except the sample 1 in which the length L of the front end portion was 11 mm. Especially, the samples 3 and 4 in each of which the length L of the front end portion was less than or equal to 9 mm were excellent in heat resistance, and the value D/L was greater than or equal to 1.1. Therefore, the samples 3 and 4 were evaluated as "good" or "excellent" in insulation property. According to this example, it was found that it is possible to obtain a spark plug that can realize both heat resistance and insulation property.

Example 3

The examiner prepared samples 11 to 16 different in the position in the axial line O direction of the front end edge 62 of the second contact surface 61 (the receiving portion 48) with respect to the front end edge 60 (the step portion 46) of the first contact surface 59 (refer to FIG. 2). In the samples 11 to 16, the width of the groove was 0.2 mm in the radial direction, the length L of the front end portion was 9 min or 10 mm, and the creepage distance D was 12 mm. In the samples 11 to 16, the position (the distance S) of the front end surface 57 at the radially outside portion with respect to the groove 52, of the front end portion 45 (refer to FIG. 2) is S=3 mm. Except difference in the dimension of each portion, the samples 11 to 16 are the same as the spark plug 10 in the first embodiment.

In the samples 13, 14, the positions in the axial line O direction are the same between the front end edge 62 (the receiving portion 48) and the front end edge 60 (the step portion 46). In the samples 11, 12, the position in the axial line O direction of the front end edge 62 (the receiving portion 48) is on the rear side (upper side of FIG. 2) by 1 mm with respect to the position in the axial line O direction of the front end edge 60 (the step portion 46). In the samples 15, 16, the position in the axial line O direction of the front end edge 62 (the receiving portion 48) is on the front side (lower side of FIG. 2) by 1 mm with respect to the position in the axial line O direction of the front end edge 60 (the step portion 46).

The examiner evaluated heat resistance and insulation property of the samples 11 to 16. An evaluation method for heat resistance and insulation property is the same as in Example 2. Results are indicated in Table 2.

TABLE 2

| No | L (mm) | D (mm) | D/L | Position of receiving portion (mm) | Heat resistance | Insulation property |
|---|---|---|---|---|---|---|
| 11 | 9 | 12.0 | 1.33 | −1 | Good | Good |
| 12 | 10 | 12.0 | 1.20 | −1 | Good | Good |
| 13 | 9 | 12.0 | 1.33 | 0 | Excellent | Good |
| 14 | 10 | 12.0 | 1.20 | 0 | Good | Good |
| 15 | 9 | 12.0 | 1.33 | 1 | Excellent | Good |
| 16 | 10 | 12.0 | 1.20 | 1 | Excellent | Good |

As indicated in Table 2, in comparison among the samples 12, 14, 16 in each of which the length L of the front end portion is 10 mm, the sample 16 in which the front end edge 62 (the receiving portion 48) was on the front side by 1 mm with respect to the front end edge 60 (the step portion 46) in the axial line O direction was more excellent in heat resistance than the samples 12, 14. In addition, in comparison among the samples 11, 13, 15 in each of which the length L of the front end portion was 9 mm, the sample 15 in which the front end edge 62 (the receiving portion 48) is on the front side by 1 mm with respect to the front end edge 60 (the step portion 46) in the axial line O direction, and the sample 13 in which the positions, in the axial line O direction, of the front end edge 62 (the receiving portion 48) and the front end edge 60 (the step portion 46) are the same were more excellent in heat resistance than the sample 11. According to this example, it was found that it is possible to obtain a spark plug that can improve heat resistance by setting the position of the front end edge of the receiving portion and the position of the front end edge of the step portion.

Example 4

The examiner prepared samples 17 to 22 different in the position (the distance S) of the front end surface 57 of the radially outside portion with respect to the groove 52, of the front end portion 45 (refer to FIG. 2). In the samples 17 to 22, the width of the groove in the radial direction was 0.2 mm, the length L of the front end portion was 9 mm or 10 mm, and the creepage distance D was 12 mm. In the samples 17 to 22, the position of the front end edge 62 (the receiving portion 48) in the axial line O direction was on the rear side (upper side of FIG. 2) by 1 mm with respect to the position of the front end edge 60 (the step portion 46) in the axial line O direction. Except difference in the dimension of each portion, the samples 17 to 22 are the same as the spark plug 10 in the first embodiment.

The examiner evaluated heat resistance and insulation property of the samples 17 to 22. An evaluation method for heat resistance and insulation property is the same as in Example 2. Results are indicated in Table 3.

TABLE 3

| No | L (mm) | D (mm) | D/L | Position of front end surface (mm) | Heat resistance | Insulation property |
|---|---|---|---|---|---|---|
| 17 | 9 | 12.0 | 1.33 | 3 | Good | Good |
| 18 | 10 | 12.0 | 1.20 | 3 | Good | Good |
| 19 | 9 | 12.0 | 1.33 | 2 | Excellent | Good |
| 20 | 10 | 12.0 | 1.20 | 2 | Excellent | Good |
| 21 | 9 | 12.0 | 1.33 | 1 | Excellent | Good |
| 22 | 10 | 12.0 | 1.20 | 1 | Excellent | Good |

As indicated in Table 3, the samples 19 to 22 in each of which the distance S was less than or equal to 2 mm were more excellent in heat resistance than the samples 17, 18 in each of which the distance S was 3 mm. According to this example, it was found that it is possible to obtain a spark plug that can improve heat resistance by setting the distance S to less than or equal to 2 mm.

As described above, although the present invention has been described based on the embodiments, the present invention is not limited to the above embodiments at all. It can be easily understood that various modifications can be devised without departing from the gist of the present invention. For example, the shapes and the dimensions of the insulators 40, 100, 140, the groove 52, the gaps 125, 168 (grooves) are mere examples and may be set as appropriate.

In the above embodiments, the case has been described where the groove 52, the gaps 125, 168 (grooves) in a cross section including the axial line O are formed in parallel with the axial line O. However, the present invention is not necessarily limited thereto. As a matter of course, the groove 52, and the gaps 125, 168 (grooves) may be inclined with respect to the axial line O (in non-parallel with the axial line O). As a matter of course, the groove 52, and the gaps 125, 168 (grooves) may be formed such that the width of the groove decreases toward the bottom portion.

In the above embodiments, the spark plugs 10, 90, 130 have been described in each of which the ground electrode 30 joined to the front end of the trunk portion 25 of the metal shell 20 projects in the axial line O direction. The present invention is not necessarily limited thereto. For example, as a matter of course, the above embodiments may be applied to a spark plug in which a ground electrode is formed in a shape surrounding the center electrode 70 (so-called creeping discharge plug), a spark plug in which a plurality of ground electrodes are disposed (so-called multipole plug), and the like.

In the above embodiments, the case has been described where the ground electrode 30 and the center electrode 70 are provided with tips 32 and 74, respectively. However, the present invention is not necessarily limited thereto. As a matter of course, the tips 32 and 74 may be omitted.

In the above embodiments, the spark plugs 10, 90, 130 each including the resistor 81 has been described. However, the present invention is not necessarily limited thereto. As a matter of course, the above embodiments may be applied to a spark plug not including the resistor 81. In this case, the resistor 81 and the conductive seal 83 may be omitted, and the center electrode 70 and the metal terminal 80 may be joined to each other by the conductive seal 82.

DESCRIPTION OF REFERENCE NUMERALS

10, 90, 130: spark plug;
20: metal shell;
27: shelf portion;
40, 100, 140: insulator;
41, 151, 161: axial hole;
45, 101, 141: front end portion;
46: step portion;
47: packing;
48: receiving portion;
52: groove;
55, 115, 157: front end surface;
57, 124, 167: front end surface;
58: connection position;
59: first contact surface;
60: front end edge;
61: second contact surface;
62: front end edge;
70: center electrode;
72: nose portion;
73: flange portion;
110, 150: first member;
114, 156: outer circumferential surface;
120, 160: second member;
123, 166: inner circumferential surface;
125, 168: gap (groove); and
O: axial line Having described the invention, the following is claimed:

1. A spark plug comprising:

a center electrode including a nose portion that extends from a front side of the spark plug to a rear side along an axial line, and a flange portion that projects to a radially outer side from a rear end of the nose portion;

a cylindrical insulator, comprising:

an axial hole penetrating the insulator along the axial line;

a front end portion formed on the front side of the spark plug, the front end portion being tubular, the front end portion having a first front end surface along an outer circumferential surface thereof, the first front end surface intersecting the axial hole at a connection position, the front end portion having an annular groove that is open to the front side of the spark plug, the groove being formed around the axial line and having a width W greater than or equal to 0.2 mm in a radial direction;

a middle trunk portion formed on the front side of the spark plug rearward of the front end portion;

a receiving portion formed on an inner circumferential surface of the middle trunk portion along the axial hole to support the flange portion of the center electrode; and a step portion formed between the middle trunk portion and the front end portion, the step portion having a diameter that decreases toward the front side of the spark plug from the middle trunk portion to the front end portion, the step portion having a contact surface, the step portion contact surface having a front end edge, the front end edge being on a frontmost side of the step portion contact surface near the axial line of the insulator; and a cylindrical metal shell disposed at a radially outer side of the insulator, the metal shell including a shelf portion that projects to a radially inner side of the metal shell and is formed on an inner circumferential surface of the metal shell, the shelf portion having a diameter that decreases from the rear side of the spark plug toward the front side of the spark plug, wherein a packing is disposed between the step portion of the insulator and the shelf portion of the metal shell, the shelf portion supporting the step portion via the packing, the step portion contact surface being in contact with the packing, wherein a length L of the front end portion extends in the axial direction from the front end edge of the step portion contact surface to the first front end surface of the front end portion of the insulator, the length L of the front end portion being less than or equal to 9 mm, wherein a front end portion gap is defined between the outer circumferential surface of the insulator and an inner circumferential surface of the metal shell, wherein a position P is defined at a frontmost point of the outer circumferential surface of the insulator at which a distance of the front end portion gap is equal to or less than 0.1 mm, wherein a creepage distance D is a distance along the outer circumferential surface of the insulator between the connection position and the position P, and wherein, in a cross section including the axial line, a value D/L obtained by dividing the creepage distance D by the length L is greater than or equal to 1.1.

2. The spark plug according to claim 1, wherein, in the axial direction, a position of a front end edge of a contact surface of the receiving portion that the flange portion contacts is the same as a position of the front end edge of the step portion contact surface or is located on the front side with respect to the front end edge of the step portion contact surface.

3. The spark plug according to claim 1, wherein the front end portion is divided into a first front end portion and a second front end portion by the groove, wherein the first front end portion is located at a radially inner side with respect to the groove, wherein the second front end portion is located at a radially outer side with respect to the groove, and wherein the second front end portion has a second front end surface within a range of 2 mm in the axial direction from the position P.

4. The spark plug according to claim 1, wherein the insulator includes an annularly formed first member and an annularly formed second member, the first and second members forming at least a part of the front end portion of the insulator, the second member being disposed at a radially outer side of the first member, wherein the groove is further defined by a gap between an outer circumferential surface of the first member and an inner circumferential surface of the second member, wherein the receiving portion is formed on the inner circumferential surface of the first member, and wherein the step portion is formed on the outer circumferential surface of the second member.

5. The spark plug according to claim 4, wherein, in the axial direction, a position of a front end edge of a contact surface of the receiving portion that the flange portion contacts is the same as a position of the front end edge of the step portion contact surface or is located on the front side with respect to the front end edge of the step portion contact surface.

6. The spark plug according to claim 3, wherein the insulator includes an annularly formed first member and an annularly formed second member, the first and second members forming at least a part of the front end portion of the insulator, the second member being disposed at a radially outer side of the first member, wherein the groove is further defined by a gap between an outer circumferential surface of the first member and an inner circumferential surface of the second member, wherein the receiving portion is formed on the inner circumferential surface of the first member, and wherein the step portion is formed on the outer circumferential surface of the second member.

7. The spark plug according to claim 6, wherein, in the axial direction, a position of a front end edge of a contact surface of the receiving portion that the flange portion contacts is the same as a position of the front end edge of the step portion contact surface or is located on the front side with respect to the front end edge of the step portion contact surface.

8. The spark plug according to claim 1, wherein the groove is separated from the step portion by the front end portion.

9. The spark plug according to claim 3, wherein the groove is separated from the metal shell by the second front end portion.

10. The spark plug according to claim 1, wherein the groove is formed nearer to the first front end surface than the step portion and the shelf portion.

11. The spark plug according to claim 2, wherein the groove is formed nearer to the first front end surface than the step portion contact surface and the receiving portion contact surface.

* * * * *